United States Patent [19]

Hyams et al.

[11] 4,094,212

[45] June 13, 1978

[54] FUSE-MATE

[75] Inventors: Irving Hyams, Philadelphia; Harold S. Koch, Plymouth Meeting; Herman Aafjes, Hatfield, all of Pa.

[73] Assignee: Fischer & Porter Company, Warminster, Pa.

[21] Appl. No.: 785,526

[22] Filed: Apr. 7, 1977

[51] Int. Cl.[2] ..... B25B 27/14

[52] U.S. Cl. ..... 81/3.8; 29/756

[58] Field of Search ..... 29/756, 758; 81/3.8; 294/99 R

[56] References Cited

U.S. PATENT DOCUMENTS

| | | | |
|---|---|---|---|
| 1,922,500 | 8/1933 | Pierce | 81/3.8 X |
| 3,654,824 | 4/1972 | Reed | 81/3.8 |

FOREIGN PATENT DOCUMENTS

| | | | |
|---|---|---|---|
| 1,438,850 | 8/1969 | Germany | 81/3.8 |

*Primary Examiner*—Gary L. Smith
*Assistant Examiner*—James G. Smith
*Attorney, Agent, or Firm*—Michael Ebert

[57] ABSTRACT

A mating device for a cartridge-type fuse to facilitate its insertion in a holder and the removal therefrom. The fuse has a tubular casing whose ends are enclosed by terminal caps which are engageable by the spring clips of the holder. The fuse mate is molded of synthetic plastic material configured to define a pair of resilient clip-on jaws adapted to spread apart and then embrace the fuse casing, the jaws projecting from and being integral with the underside of a rectangular shield which protectively covers the entire fuse and the "live" holder clips. Formed on the upper side of the shield and integral therewith is a block-shaped handle having concave sides to define finger depressions and a face which lends itself to marking.

5 Claims, 6 Drawing Figures

Fig. 1.
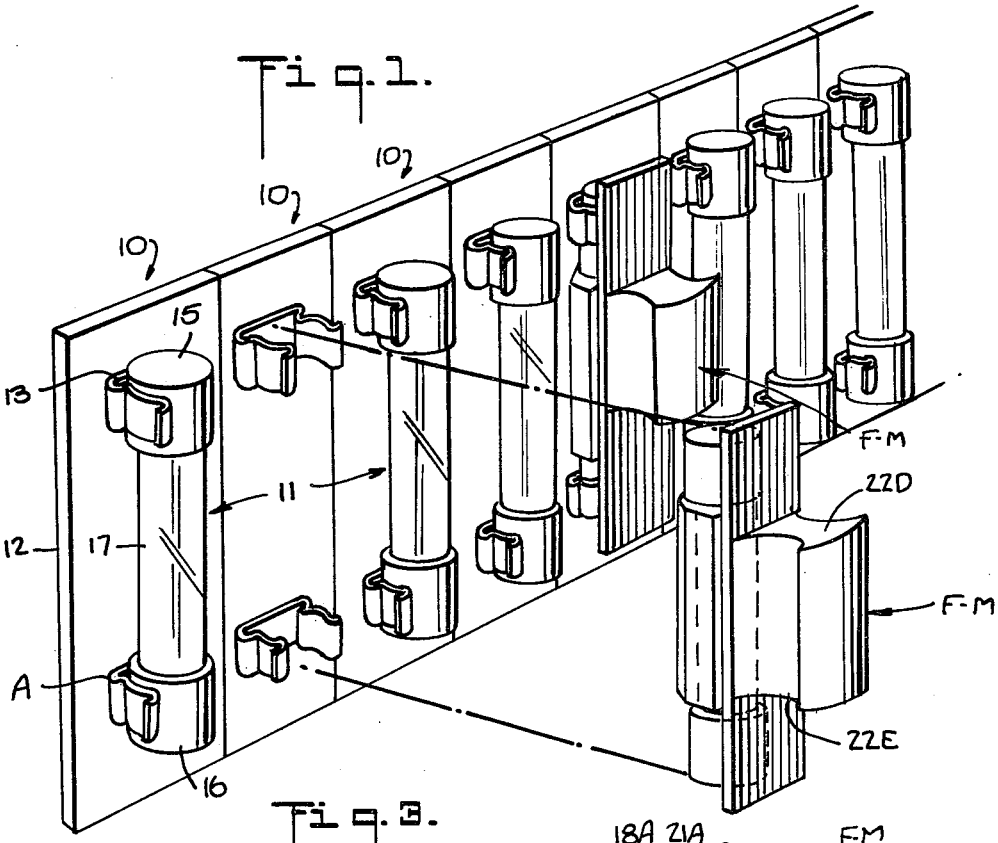
Fig. 3.
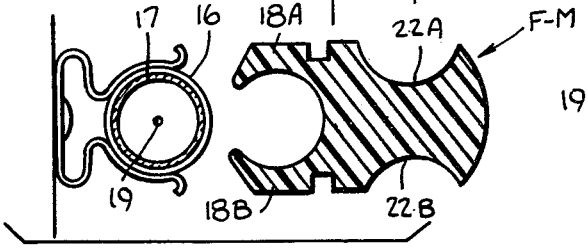
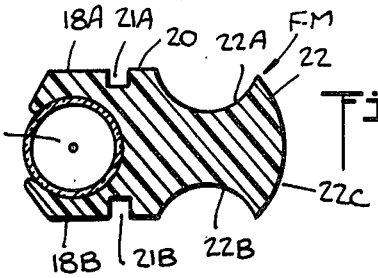
Fig. 4.
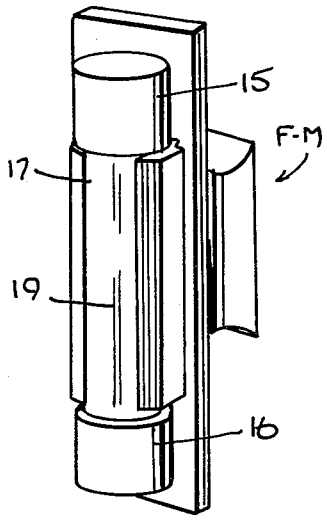
Fig. 2.
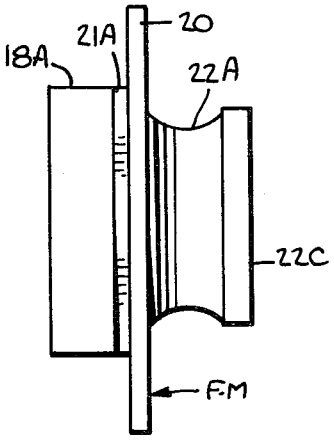
Fig. 5.
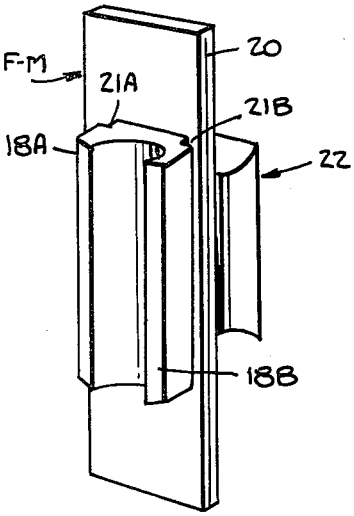
Fig. 6.

FUSE-MATE

BACKGROUND OF INVENTION

This invention relates generally to cartridge-type electrical fuses, and more particularly to a mating device which facilitates insertion of such fuses into a fuse holder and the removal thereof, the fuse mate also carrying out other useful functions.

A fuse is a protective device containing a short length of special wire that melts when the current therethrough exceeds the rated value for a given period. Because the fuse is inserted in series with the circuit to be protected, it opens this circuit automatically in the event of an unacceptable overload.

The fuse commonly used in conjunction with electronic equipment is of the so-called cartridge type. This is constituted by a tubular casing of glass or other clear insulating material whose ends are enclosed by metal terminal caps, the fuse wire extending through the casing and bridging the caps. Since the fuse wire is visible through the transparent casing, should an overload occur which melts the wire, the blown condition of the fuse then becomes evident. In some cases, the casing is of opaque or ceramic material.

Cartridge fuses are socketed in holders formed by an insulating base on which a pair of metal spring clips is mounted to engage the terminal caps of the fuse, the circuit connections being made to the clips. In many instances, an array of parallel holders are formed on a common base so that the fuses are then very close to each other. Normally, to install a fuse, one grips the casing thereof between the thumb and forefinger and then pushes the fuse into the holder clips. And to remove a fuse from the holder, one again grips the casing with the fingers to pull the fuse from the holder clips.

To insure efficient electrical contact between the holder clips and the fuse terminal caps, the clips are designed to apply a substantial clamping pressure on the caps. These pressures make insertion and removal of the fuse quite difficult, which difficulty is compounded when the fuses are small or where a family of fuses are very close to each other. Moreover, because at least one holder clip is alive, and the gripping fingers are quite close to the terminal caps, there is a danger of shock, particularly if resistance is experienced in removing or inserting a fuse in the course of which the fingers are shifted toward the caps.

Because of problems encountered in removing cartridge type fuses, the use of screw drivers to pry the fuse from the holder is not uncommon. This can lead not only to fracture of the relatively delicate fuse casing, but it may also result in the short-circuiting of adjacent fuse holders.

To overcome these difficulties, various forms of cartridge-type fuse extractors have heretofore been proposed, all of which include some means to grip the fuse casing and a handle to pull the clamped fuse out of the holder. Thus U.S. Pat. No. 1,380,242 shows a fuse extractor having a pair of jaws adapted to receive and retain a cartridge fuse, with a long handle to isolate the user from the fuse terminals. The extractor is designed so that after a fuse is inserted in its holder, the jaws can be disengaged therefrom. Other forms of fuse extractors or pullers adapted to engage, and then release the fuse, are disclosed in U.S. Pat. Nos. 2,454,870; 3,215,006; and 3,654,824.

In fuse extractors or pullers of the type heretofore known, the tool is only put to use when a fuse is in need of insertion or removal, so that under normal circumstances, the cartridge fuses in a given piece of electronic equipment are socketed in their holders with their live terminals exposed. These fuses are disregarded unless an overload occurs which renders the equipment inoperative. It is only when this happens that one has occasion to check the several protective fuses to see which one is blown and in need of replacement.

Because all of the live terminals are exposed, in seeking to extract a given fuse, one may accidentally make contact with an adjacent live terminal. And since the fuse wire usually has a silver-like appearance and is enclosed within a clear casing, it is difficult to discern the condition of the wire in each fuse, especially when the fuses are in a closely packed array. Hence it may be necessary to extract the fuses one at a time with a suitable extractor and to examine each fuse in a good light, if one is available, to see whether it is blown. Finally, when the blown fuse is located, one must then replace this fuse with a fresh fuse having the same rating. This sometimes presents a problem, especially with small cartridge fuses whose ratings are inscribed on caps and are hard to make out.

SUMMARY OF INVENTION

In view of the foregoing, the main object of this invention is to provide a fuse mate adapted to facilitate the insertion and removal of a cartridge-type fuse.

More particularly, it is an object of this invention to provide a fuse mate which may be permanently clipped onto a fuse, the fuse mate being highly compact whereby even when an array of fuses are arranged in holders placed in close proximity to each other, there is no interference between adjacent mated fuses, and any mated fuse may be inserted or withdrawn from the array thereof without difficulty.

A significant feature of a fuse mate in accordance with the invention is that it functions not only as a fuse extractor, but also acts as a shield to protectively cover the fuse and the underlying "live" terminal clips to obviate the danger of electrical shock.

Another advantage of the fuse mate is that its handle is provided with a face which lends itself to marking with the rating of the fuse held thereby, so that when a fuse is blown, one then knows the rating of the necessary replacement. Alternatively, the rating may be marked on the shield. Yet another advantage of the fuse mate is that when the fuse clamped therein is visually examined, the fuse wire within the clear casing is seen against an opaque background, and its condition is more readily discernible.

Also an object of the invention is to provide a fuse mate molded of synthetic plastic material, which fuse mate may be mass-produced at low cost, such that, as a practical matter, one can afford to discard a fuse mate coupled to a blown fuse rather than retain the mate and replace the fuse therein. Consequently, fuses of a given rating may be coupled at the factory with fuse mates which are labelled with their ratings, and these mated fuses may be appropriately packaged so that the user has no need to install a fuse in a fuse mate. When the occasion arises, the user simply replaces a blown mated fuse with a fresh one. Thus both the fuse and the mate therefor are disposable.

Briefly stated, these objects are attained by a fuse mate molded of synthetic plastic material having good insulation properties and adequate structural strength, the fuse mate being configured to define a pair of elongated resilient clip-on jaws whose length is slightly shorter than the length of the casing of the fuse to be engaged thereby between the end caps, the jaws being adapted to spread apart and embrace the casing.

The jaws project from and are integral with the underside of a rectangular shield which protectively covers the entire fuse and the "live" electrical holder clips thereunder. Formed on the upper side of the shield and integral therewith is a block-shaped handle having concave sides to define finger depressions and a face which lends itself to marking.

OUTLINE OF DRAWINGS

For a better understanding of the invention as well as other objects and further features thereof, reference is made to the following detailed description to be read in conjunction with the accompanying drawings, wherein:

FIG. 1 is a perspective view of an array of standard holders for cartridge-type fuses, some of the holders having fuses therein which are coupled to fuse mates in accordance with the invention;

FIG. 2 shows in perspective a single fuse coupled to a fuse mate;

FIG. 3 is a transverse section taken through a fuse held by spring clips of a holder and the fuse mate to be coupled thereto;

FIG. 4 shows in transverse section the fuse mate coupled to the fuse;

FIG. 5 is a side view of the fuse mate; and

FIG. 6 is a bottom view of the fuse mate.

DESCRIPTION OF INVENTION

Referring now to FIG. 1, there is shown an array of standard fuse holders, generally designated by numeral 10, one directly against the other so that the cartridge-type fuses 11 retained in the holders are in close proximity to each other. As previously explained, in a typical piece of electronic equipment having several protective fuses in a range of ratings appropriate to the equipment, an array of this type is not uncommon and present difficulties in removing and replacing individual fuses.

Each holder 10 is constituted by a rectangular insulating base 12 on which is mounted a pair of metal clips 13 and 14 at spaced positions. These clips are formed with spring fingers adapted to engage and to electrically connect with the terminal caps 15 and 16 enclosing the ends of the transparent casing 17 of the cartridge fuse. A fuse wire 19 is disposed within the casing, the wire bridging end caps 15 and 16.

Clips 13 and 14 are electrically "live," since they are connected to the electrical circuit which is to be protected against an excessive overload. In the event of an excessive overload—that is, one exceeding the rating of the fuse—the wire is caused to melt to break the circuit and interrupt the flow of current therethrough.

The one-piece mate for the fuse is generally designated as F-M and is molded of a synthetic plastic material, such as polyethylene having good insulating qualities and the property of resilience. Fuse mate F-M is configured to define a pair of elongated resilient jaws 18A and 18B whose inner walls are contoured to conform to the cylindrical surface of fuse casing 17. The length of the jaws is slightly shorter than the length of the casing between end caps 15 and 16, so that the jaws may be clipped onto the casing between these caps. When the fuse casing is forced between the jaws, the jaws yield to permit entry of the casing, the jaws then clamping onto the casing surface.

Jaws 18A and 18B project from and are integral with the underside of a rectangular shield 20 whose length is somewhat greater than the length of the cartridge fuse clamped between the jaws and whose width is somewhat greater than the width of the fuse so that the shield acts to protectively cover the fuse and the "live" holder clips thereunder. The flexibility of the jaws is enhanced by longitudinal notches 21A and 21B at the junction of the jaws and the shield.

Formed on the outer surface of shield 20 is a block 22, the width of the block being the same as that of the shield, the length of the block being shorter than that of the shield and being centered thereon. The opposing sides 22A, 22B, 22D and 22E of the block are concave to form finger depressions to facilitate handling of the fuse mate from any direction. The block 22 is provided with a slightly convex face 22C onto which one may adhere a label bearing rating and other data which is then readily viewable by the user. The rating may be marked on shield 20.

Thus when a fuse 11 is coupled to a fuse mate F-M in the manner shown in FIGS. 1 and 2, it becomes possible to insert the fuse into a standard holder therefor or to extract the fuse from the holder without difficulty and without any danger of finger contact with the "live" clips of the holder; for the fingers are well isolated from the end caps of the fuse and the holder clips. One may therefore insert or remove a fuse in poor light without fear of shock.

Even though the fuse holders are directly adjacent each other in the array shown in FIG. 1, the width of the fuse mate is substantially less than the width of holder base 12; hence there is adequate room between the couples to permit the insertion of fingers therebetween.

Fuse mate F-M is formed of opaque material which may be white or in different colors. Hence, rather than label the ratings of the fuses on the fuse mate, the fuse mates may be color-coded to represent different ratings, such as red for 0.25 amps, green for 0.50 amps, and so on. When, as shown in FIG. 2, one wishes to examine the condition of fuse wire 19 in the fuse to determine whether the fuse is blown, one then sees this wire within the clear casing 17 against the opaque background of the mate, and its state is therefore more readily discernible.

In practice, one may use a single fuse mate as a tool to insert fuses into holders or to extract fuses therefrom, in which event, when a blown fuse is located and extracted, it must be detached from the mate and a fresh fuse coupled thereto. However, since the fuse mates can be fabricated in quantity at very low cost, the fuse mates may be coupled at the factory to appropriate fuses and supplied to users as couples, in which event the couples are installed in the fuse holders and remain therein until it is necessary to replace a blown fuse, in which case the blown couple is removed and discarded and a fresh couple put in place.

Since fuse cartridges come in various diameters and lengths, their companion fuse mates must be dimensioned accordingly. It is also to be noted that cartridge fuses in large ratings often come with casings made of fibrous material rather than glass or clear plastic, and that one can provide fuse mates appropriate to these sizes.

While there has been shown and described a preferred embodiment of a fuse mate in accordance with the invention, it will be appreciated that many changes and modifications may be made therein without, however, departing from the essential spirit thereof. Thus it may be desirable in some instances to be able to pull out all fuse couples in a row thereof, so that one can examine the fuses to see which one has blown. To this end, one can provide a bridging strip having a row of tracks on the underside which clip onto the several handles of the fuse mates, the strip having a handle thereon making it possible to pull out all of the couples simultaneously.

I claim:

1. A fuse mate of insulating material adapted to be coupled to a cartridge-type fuse having a fuse wire disposed within a cylindrical casing whose ends are enclosed by terminal caps, said caps being engageable by the spring clips of a fuse holder, said mate facilitating the insertion or extraction of said fuse and comprising:

A a shield dimensioned to protectively cover said fuse and having a length which is at least equal to that of the fuse so as to overlie the caps and the spring clips;

B a pair of elongated resilient jaws projecting from the underside of said shield, said jaws having an inlet opening which is normally narrower than the diameter of the casing, the inlet opening being dilatable to permit the jaws to clamp onto and to conform to said casing, said jaws having a length substantially shorter than that of said shield so as to be in contact with the casing between said end caps; and C a block on the outside of said shield forming a handle for said fuse mate, said shield, said jaws and said block being integral with each other and being fabricated from a single molded piece of synthetic plastic material.

2. A fuse mate as set forth in claim 1, wherein said casing is of transparent material and said fuse mate is of opaque material whereby the wire in said casing may be readily seen against an opaque background to determine its state.

3. A fuse mate as set forth in claim 1, further including longitudinally-extending notches at the junctions of said jaws and said shield to enhance the flexibilty of said jaws.

4. A fuse mate as set forth in claim 1, wherein the sides of said block are concave to define finger depressions.

5. A fuse mate as set forth in claim 4, wherein said block has a substantially flat face to receive a marking label.

* * * * *